United States Patent [19]

Mathur

[11] 4,126,029

[45] Nov. 21, 1978

[54] METHOD OF FORMING HOLLOW CYLINDRICAL PARTS WITH INTERNAL CONTOURS

[75] Inventor: Pracheeschwar S. Mathur, Cambridge, Mass.

[73] Assignee: General Electric Company, Lynn, Mass.

[21] Appl. No.: 746,973

[22] Filed: Dec. 2, 1976

[51] Int. Cl.[2] ..... B21H 1/06

[52] U.S. Cl. ..... 72/69; 72/91

[58] Field of Search ..... 72/69, 91, 105, 106

[56] References Cited

U.S. PATENT DOCUMENTS

| | | | |
|---|---|---|---|
| 1,406,895 | 2/1922 | Reifurth | 72/106 |
| 3,029,667 | 4/1962 | Sporck | 72/105 |
| 3,160,036 | 12/1964 | Ernestus | 72/91 |
| 3,382,693 | 5/1968 | Rozhdestvensky | 72/91 |
| 3,498,095 | 3/1970 | Marcovitch | 72/91 |
| 3,685,475 | 8/1972 | Banks | 72/69 |

*Primary Examiner*—Lowell A. Larson

*Attorney, Agent, or Firm*—Derek P. Lawrence; Henry J. Policinski

[57] ABSTRACT

Hollow cylindrical metal structures with internal contours are constructed from a thick-walled hollow cylinder of axial length, weight and outside diameter substantially equal to the axial length, weight and outside diameter of the desired preform. The cylinder is placed in a restraining cylindrical container having an inside diameter and length substantially equal to the outside diameter and length respectively of the cylindrical structure. The entire assembly is then rolled between a forming roll die having a contoured outside face abutting the inside face of the hollow cylinder and a support roll die abutting the outside face of the container until the inside face of the hollow cylinder conforms to the profile of the forming roll. Radial growth of the hollow cylinder during this contouring operation is inihibited by the cylindrical container. Axial growth of the hollow cylinder during the contouring operation is also inhibited with the help of flanges on the roll dies. To facilitate material flow during the contouring operation the entire assembly is heated with the cylindrical container and roll dies heated to a substantially less temperature than the hollow cyclinder.

5 Claims, 6 Drawing Figures

Fig 1
PRIOR ART
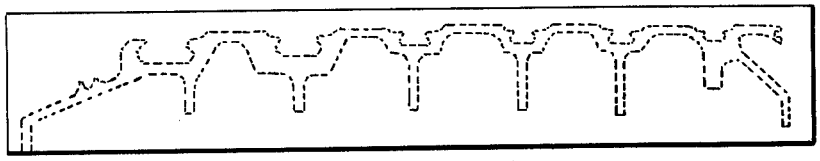
Fig 2
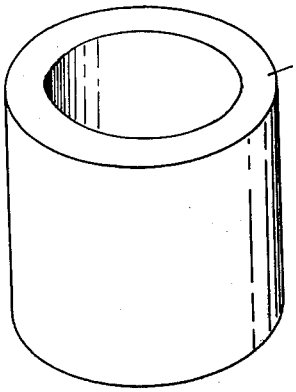
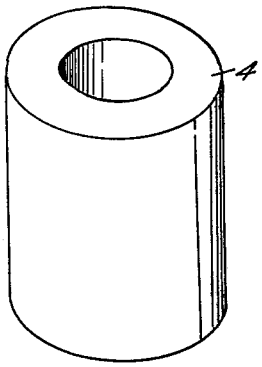
Fig 3
Fig 4
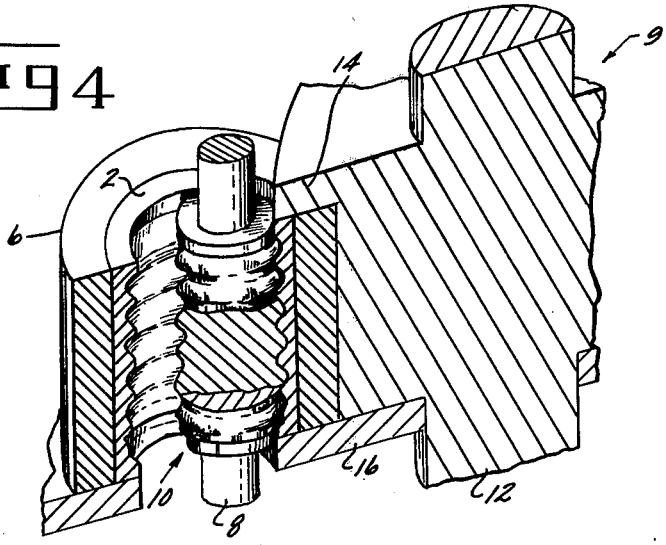
Fig 6
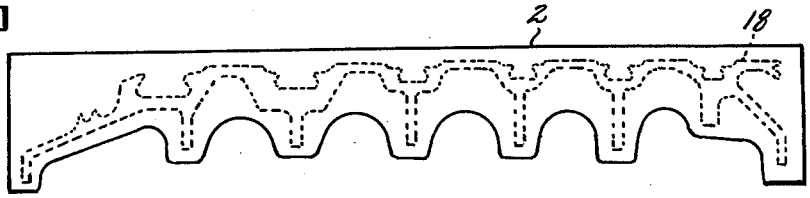

METHOD OF FORMING HOLLOW CYLINDRICAL PARTS WITH INTERNAL CONTOURS

BACKGROUND OF THE INVENTION

This invention relates to a method of manufacture and in particular relates to a method of manufacturing cylindrical metal structures having discrete internal contours.

Cylindrical metal structures are used throughout industry in a wide variety of applications. Such structures are particularly useful in the construction of parts for gas turbine engines including the construction of rotor spools. Typically, rotor spools for gas turbine engines have been machined from thick-walled, heat treated, metal cylindrical forgings of rectangular or other simple cross-section having an axial length substantially equal to that of the rotor, an internal radial diameter slightly less than that of the rotor and a wall thickness slightly greater than the thickest part of the rotor. The cross-sections of a typical starting forging 1 and rotor 18 to be machined therefrom is shown in FIG. 1. In this machining operation, a lathe is used to cut away excess material from the starting metal cylindrical forging in order to achieve the desired internal contour. Typically in such an operation as much as 80% of the original starting material may have to be removed in order to achieve the desired internal contour. Accordingly, such prior art machining methods have been found to be both extremely time consuming and wasteful. This problem is particularly acute in the construction of rotors for use in gas turbine engines because of the relatively expensive, high-temperature metal alloys used and the relatively high cost to machine these tough alloys.

OBJECT OF THE INVENTION

It is an object of the present invention to provide a process for the manufacture of cylindrical metal structures having internal contours and radial diameters which closely approximate those of a rotor to be constructed therefrom.

It is a further object of this invention to provide a process for the manufacture of cylindrical metal structures having discrete internal contours in which there is no wastage of starting material.

It is still a further object of this invention to provide a method of constructing a cylindrical metal structure from which a gas turbine engine rotor may be machined in significantly less time and with less wastage of material than prior art manufacturing techniques.

SUMMARY OF THE INVENTION

The starting material for the method of this invention is a metal cylinder of rectangular or other regular cross-section, having a weight, outer diameter, and axial length substantially equal to the weight, outer diameter and axial length respectively of a desired final cylindrical structure and having a wall thickness slightly less than the thickest part of the desired final structure.

The starting cylinder is placed in a restraining cylindrical container having an inside diameter substantially equal to the desired outside diameter of the final structure and having an axial length substantially equal to that of the desired final structure. The entire assembly is thereafter rolled between a forming roll die abutting the inside face of the starting cylinder having external contours corresponding to the internal contours desired to be placed on the final structure and a support roll die abutting the outside face of the cylindrical container until the inside face of the starting cylinder has been contoured to conform to the profile of the forming roll. Radial growth of the starting cylinder during this contouring operation is inhibited by the metal cylinder which because it is thicker and constructed of a material significantly tougher than that used for the starting cylinder does not deform under pressures exerted by the forming and support roll dies. Axial growth of the starting cylinder during the contouring operation is inhibited with the help of flanges formed on the forming roll die. To facilitate the material flow during the contouring operation the starting cylinder may be heated and maintained at that temperature during contouring. The roll dies and restraining container may also be heated to a lower temperature to prevent chilling of the starting cylinder during the rolling operation. By restraining radial and axial growth during contouring a high degree of accuracy in the dimensions of the contoured structure is achieved. The resulting structure will have an inside diameter which is smaller than that of the starting cylinder at some point along the axial length.

This process produces a cylindrical metal structure with internal contours which approximates the contours of a rotor spool to be machined therefrom. Because the internal contours of the structure more closely approximates the internal contours of the rotor, material loss is significantly reduced in the construction of rotors using cylindrical structure manufactured according to the process of this invention. Further, because less material has to be removed from the structure, rotors are machined in significantly less time than required using manufacturing techniques of the prior art.

A further advantage of this invention is that rotors machined from heat treated cylindrical structures constructed in accordance with the teachings of this invention exhibit significantly improved stength properties over rotors constructed in accordance with the teachings of the prior art. This is because the heat treated structures which have been contoured in accordance with the teachings of this invention are significantly thinner than the heat treated forgings from which rotors of the prior art are machined. Because heat is more quickly and uniformly distributed through such thinner structures when they are heat treated they exhibit improved strength properties.

BRIEF DESCRIPTION OF THE DRAWINGS

The invention may be better understood from reading the following description in conjunction with the drawings in which:

FIG. 1 is a cross-sectional view of a prior art forging having the cross-section of rotor imposed thereon.

FIG. 2 is a perspective view of a starting cylinder used in the method of this invention.

FIG. 3 is a perspective view of a cylinder used to construct the cylinder of FIG. 2.

FIG. 4 is a perspective view of a portion of machinery useful for the practice of the method of this invention.

FIG. 6 is a cross-sectional view of the structure of FIG. 5 having the cross-section of a rotor imposed thereon.

DESCRIPTION OF THE PREFERRED EMBODIMENT

Figure 5:
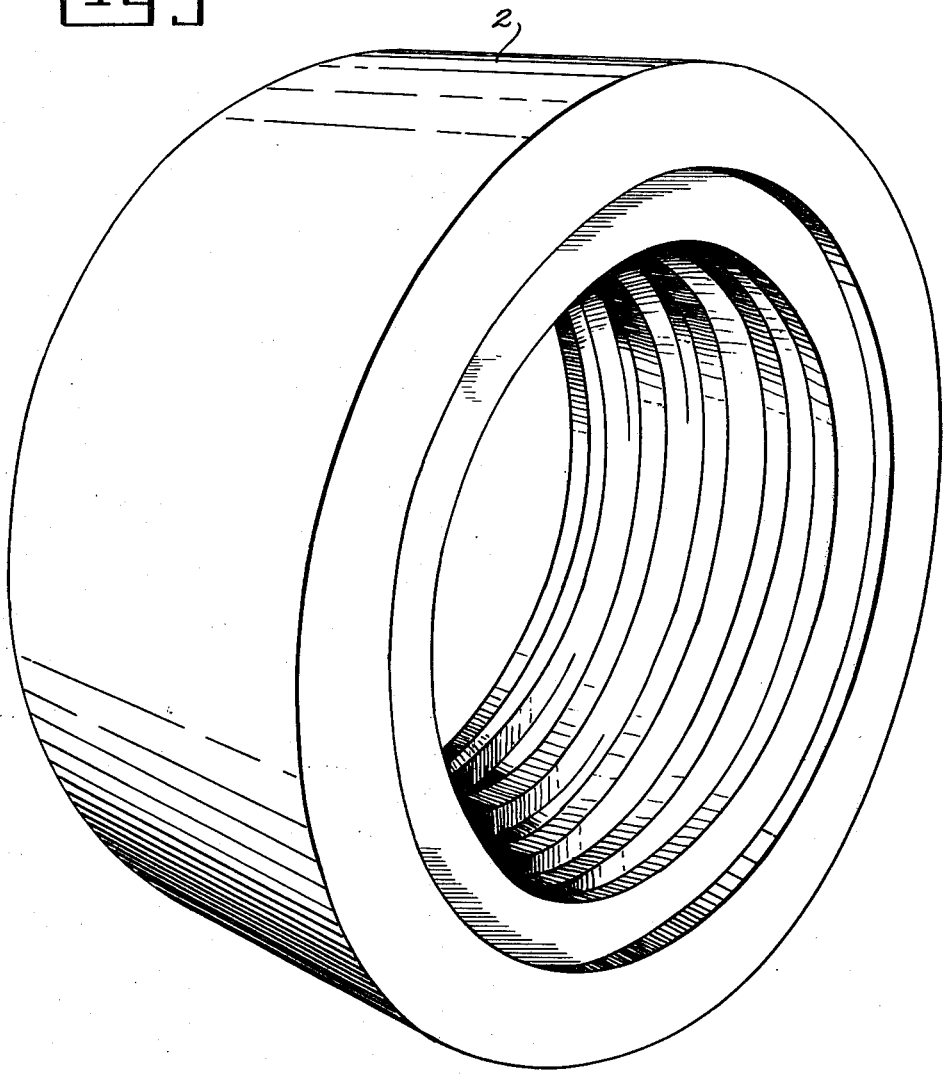
FIG. 5 is a perspective view of a cylindrical metal structure constructed in accordance with the teachings of this invention.

In performing the method of this invention, a suitable hollow metal cylinder 2 of rectangular or other regular cross-section such as shown in FIG. 2 is used as the starting material. The cylinder 2 should have a weight, outer diameter, and axial length substantially equal to the weight, outer diameter and axial length respectively of a desired final cylindrical structure. The inside diameter of the cylinder 2 is carefully selected to permit the requisite amount of contouring with minimum excess material. Generally the inside diameter of cylinder 2 will be slightly greater than the inside diameter at the thickest part of the final structure. The starting cylinder 2 may be constructed using known prior art techniques such as by back extruding a metal billet to form an elongated cylinder and thereafter slicing this into cylinders of desired length; or by forging; or deep drawing a cylinder from a plate. Alternatively, the starting cylinder 2 may be constructed by radially enlarging a smaller cylinder 4 shown in FIG. 3. The cylinder 4 should have a weight and axial length substantially identical to the weight and axial length of the cylinder 2. The thickness of the cylinder 4 must be carefully selected such that when it is radially enlarged it will have a thickness substantially the same as the cylinder 2. Depending on the relative inside and outside diameters of the cylinders 2 and 4, the cylinder 4 will be two to three times thicker than the cylinder 2. The cylinder 4 may be hot or cold rolled to radially enlarge its inside and outside diameter to those of the cylinder 2.

In accordance with the method of this invention the cylinder 2 is placed in a restraining cylindrical container 6 as shown in FIG. 4. The container 6 has an inside diameter substantially equal to the outside diameter of cylinder 2, has an axial length substantially equal to the axial length of cylinder 2 and is substantially thicker than the cylinder 2. The container 6 should also be constructed of a material significantly tougher than the material from which the cylinder 2 is constructed such that rolling pressures sufficient to deform cylinder 2 do not deform container 6. A preferred material for container 6 when titanium is used for cylinder 2 is a nickel base super alloy such as INCO-718. The container 6 and cylinder 2 are rolled on a conventional ring rolling mill well known in the art, a portion of which is shown in FIG. 4. The rolling mill shown generally at 9 includes a forming roll die 8 and a support roll die 12 mounted for rotation on a base structure (not shown).

In operation, the container 6 and cylinder 2 are placed between the forming and support dies such that the forming die 8 abuts the inside face of the cylinder 2 and the support die abuts the outside face of the container 6. The forming die 8 includes contours shown generally at 10 on its external face which correspond to the desired internal contours of the final structure.

The container 6 and cylinder 2 are rolled between the dies 8 and 12 until the inside face of the cylinder 2 has been contoured to conform to the profile of the forming roll die 8. A typical cylindrical structure produced in accordance with the teachings of this invention is shown in FIGS. 5 and 6. Radial growth of the cylinder 2 during the contouring operation is inhibited by the restraining cylinder 6 which because it is thicker and constructed of a material significantly tougher than that used for the starting cylinder does not deform under pressures exerted by the forming and support roll dies. Axial growth of the starting cylinder 2 during the contouring operation is inhibited with the help of radially extending flanges 14 and 16 formed at opposite ends of support roll 12 which engage opposed ends of the cylinder 2. Alternatively, lower flange 16 may be eliminated by using the base of the machine which supports the dies (not shown) to inhibit axial growth in the downward direction.

To facilitate the material flow during the contouring operation the cylinder 2 may be heated and maintained at an elevated temperature during contouring. It will also be necessary to heat the rolls and restraining container to prevent chilling of the starting cylinder during the rolling operation. However, the restraining container and rolls are heated to a lesser temperature than the starting cylinder such that the restraining container will not deform during the rolling operation. When forming titanium alloy cylinders a temperature of 1500° F. to 1600° F. for cylinder 2 and a temperature of approximately 800° F. for container 6 and roll dies 8 and 12 has been found to be satisfactory when rolling at pressures of 30,000 to 40,000 pounds per square inch.

By restraining the radial and axial growth of cylinder 2 during contouring, a high degree of accuracy is achieved in the dimensions of the final structure. This process produces a cylindrical metal structure having internal contours which closely approximates the contours of a rotor spool to be machined therefrom.

To produce a spool 18 as shown in FIG. 6, cylindrical structure 2 is heat treated and the spool 18 thereafter machined therefrom. As can be seen by examination of FIGS. 1 and 6 because the structure 2 more closely approximates the contours of the rotor 18, material loss is significantly reduced in the construction of rotors using cylindrical structures contoured according to the process of this invention. Further, because less material has to be removed from the final structure rotors are constructed in significantly less time than manufacturing techniques of the prior art.

A further advantage of this invention is that rotors machined from heat treated contoured structures constructed in accordance with the teachings of this invention exhibit significantly improved strength properties than rotors constructed in accordance with the teachings of the prior art. This is because the heat treated cylindrical structures are significantly thinner than the heat treat forgings from which rotors of the prior art are machined. Because heat is more quickly and uniformly distributed through such thinner structures when they are heat treated, they exhibit improved strength properties.

While the starting structure for the method of this invention has been depicted as comprising a simple hollow cylinder, it is also possible to form other cylindrical type structures in accordance with the teachings of this invention. Alternative structures which may be formed include cylindrical vessels with external faces which have been circumferentially relieved in desired areas and/or which may include tapered inner and outer faces.

While particularly useful in the construction of cylindrical metal structures for gas turbine engines, the method of this invention may be utilized to produce cylindrical metal structures for any application requiring internal contours.

Therefore, having described a preferred method of the present invention, though not exhaustive of all equivalents, it will be appreciated by those skilled in the art many modifications, substitutions and changes may be made thereto without departing from the fundamental theme of the invention. Therefore what is desired to be secured by Letters Patent is as follows:

I claim:

1. A method of manufacturing a hollow cylindrical metal structure having a plurality of internal contours comprising the steps of:

constructing an initial hollow metal cylinder having a weight, outside diameter and axial length substantially equal to the weight, outside diameter and axial length respectively of the desired structure and having a smooth outer surface, placing the initial cylinder within a cylindrical container having a smooth inner surface conforming to the outer surface of the cylinder, rolling the cylinder between a forming roll die abutting the internal face of the initial cylinder and having a plurality of axially spaced external contours corresponding to the desired internal contours on the structure and a support roll die opposed to the forming roll die and engaging said container, while simultaneously restraining outward radial growth and axial growth of the cylinder, until the internal face of the cylinder conforms to the profile of the abutting forming roll die.

2. The method of claim 1 wherein the cylindrical container is thicker than the initial cylinder and is made of a material significantly tougher than the material from which the initial cylinder is made such that rolling forces applied to the initial cylinder and container which are sufficient to deform the initial cylinder do not deform the container.

3. The method of claim 2 wherein the initial cylinder is restrained from axial growth during rolling by a pair of radially extending flanges disposed at opposite ends of the support roll die which engage opposed ends of the initial cylinder.

4. The method of claim 1 wherein during the contouring operation the initial cylinder is maintained in a first temperature range sufficient to facilitate flow of the material from which it is constructed and the cylindrical container and the forming roll die and the support roll die are maintained in a second temperature range significantly lower than said first temperature range, said second temperature range being sufficient to inhibit excessive chilling of the initial cylinder during the contouring operation but insufficient to cause deformation of the cylindrical container during the contouring operation.

5. The method of claim 1 wherein the inside diameter of the initial cylinder is slightly greater than the inside diameter of the thickest portion of the final structure.

* * * * *